US007278404B2

(12) United States Patent
Wolters et al.

(10) Patent No.: US 7,278,404 B2
(45) Date of Patent: Oct. 9, 2007

(54) FUEL SUPPLY SYSTEM AND A METHOD FOR CONTROLLING THE FUEL SUPPLY

(75) Inventors: Stefan Wolters, Korschenbroich (DE); Gerd Rosemann, Moenchengladbach (DE)

(73) Assignee: TI Automotive (Neuss) GmbH, Neuss (DE)

( * ) Notice: Subject to any disclaimer, the term of this patent is extended or adjusted under 35 U.S.C. 154(b) by 0 days.

(21) Appl. No.: 11/037,940

(22) Filed: Jan. 18, 2005

(65) Prior Publication Data

US 2005/0178367 A1 Aug. 18, 2005

(30) Foreign Application Priority Data

Feb. 18, 2004 (DE) ..... 10 2004 007 878

(51) Int. Cl.
*F02M 37/04* (2006.01)

(52) U.S. Cl. ..... 123/514; 123/456

(58) Field of Classification Search ..... 123/514, 123/506, 456, 446, 357, 467, 179.17; 137/565.17, 137/565.34, 574
See application file for complete search history.

(56) References Cited

U.S. PATENT DOCUMENTS 5,148,792 A * 9/1992 Tuckey ..... 123/497
5,289,810 A 3/1994 Bauer et al.
5,361,742 A * 11/1994 Briggs et al. ..... 123/506
5,749,345 A * 5/1998 Treml ..... 123/456
5,797,377 A * 8/1998 Fischerkeller ..... 123/514
6,123,511 A * 9/2000 Sertier ..... 417/87
6,412,475 B1 * 7/2002 Joos et al. ..... 123/510
6,457,459 B1 * 10/2002 Schelhas et al. ..... 123/514
6,805,106 B2 * 10/2004 Kumagai et al. ..... 123/514

(Continued)

FOREIGN PATENT DOCUMENTS

CA 2321606 4/2001

(Continued)

OTHER PUBLICATIONS

International Search Report dated May 17, 2005.

*Primary Examiner*—Carl S. Miller
(74) *Attorney, Agent, or Firm*—Ohlandt, Greeley, Ruggiero & Perle L.L.P.

(57) ABSTRACT

A fuel supply system for supplying an internal combustion engine with fuel comprises an electric fuel pump arranged with a fuel tank. A fuel line leading to the internal combustion engine is connected with the fuel pump. A return line returning fuel toward the fuel pump is connected with the fuel line. Further, a shunt is connected with the fuel line via which a sucking jet pump arranged in the fuel tank is operated. The fuel supply system comprises a pressure control system that opens or closes the connection of the shunt to the fuel line at a first pressure and opens or closes the connection of the return line with the fuel line at a second pressure. When the pressure increases, the shunt and the return line are opened by the pressure control system, and when the pressure drops, they are closed. When the internal combustion engine is started, the fuel line is thus only connected with the internal combustion engine so that the starting procedure is accelerated whereby the electric fuel pump is supplied with sufficient power more quickly so that the fuel supply of the internal combustion engine is improved.

7 Claims, 3 Drawing Sheets

U.S. PATENT DOCUMENTS

| | | | | |
|---|---|---|---|---|
| 2001/0018908 | A1 | 9/2001 | Joos et al. | 123/497 |
| 2003/0159681 | A1 | 8/2003 | Schueler et al. | 123/514 |

FOREIGN PATENT DOCUMENTS

| | | |
|---|---|---|
| DE | 4443836 | 6/1996 |
| DE | 19805070 | 8/1999 |
| DE | 103 03 390 | 8/2004 |
| EP | 1 152 142 | 11/2001 |
| JP | 2003247469 | 9/2003 |

* cited by examiner

FUEL SUPPLY SYSTEM AND A METHOD FOR CONTROLLING THE FUEL SUPPLY

BACKGROUND OF THE INVENTION

1. Field of the Invention

The invention relates to a fuel supply system for supplying an internal combustion engine, particularly a motor vehicle, with fuel as well as a method for controlling the fuel supply of an internal combustion engine.

2. Description of Related Art

For supplying an internal combustion engine with fuel, it is known to dispose an electric fuel pump in a fuel tank, feeding fuel to the internal combustion engine via a fuel line. From German Patent DE 199 48 170 A1, it is known to carry off a part of the fed fuel via a shunt to operate a sucking jet pump therewith. By the operation of the sucking jet pump, it is possible to sufficiently supply a fuel pump arranged in a surge pot with fuel so that the fuel pump feeds enough fuel to supply the internal combustion engine. Further, it is known to return a part of the fuel fed by the fuel pump to the fuel pump, particularly into the surge pot, via a return line. Due to the fact that a part of the fed fuel is circulated, the cooling of the fuel pump is considerably improved.

In such fuel supply systems, the electric fuel pump and/or the number of the used sucking jet pumps is intentionally over dimensioned to provide for a sufficient supply of fuel when the internal combustion engine is started and there only is a low board voltage for the operation of the electric fuel pump. Because of the over dimensioning, such fuel supply systems are expensive and require a correspondingly large building space. Further, it requires a great lot of time until the desired operational state of the internal combustion engine is reached after the start since a great part of the fed fuel quantity is not used for the internal combustion engine but for the sucking jet pumps provided.

It is further known from DE 199 48 170 A1 to control the flow rate of the electric fuel pump in dependence on the pressure in the fuel line. Since the course of the board voltage is not completely known when the internal combustion engine is started, a reliable fuel supply of the internal combustion engine by controlling the fuel pump is not possible. To guarantee a reliable fuel supply during the start of the internal combustion engine as well, an intentional over dimensioning of the employed fuel supply system is thus required.

SUMMARY OF THE INVENTION

It is an object of the invention to provide a compact fuel supply system and a method for controlling the fuel supply of an internal combustion engine which respectively guarantee a reliable fuel supply when the internal combustion engine is started.

This object is solved, according to the invention, by a fuel supply system as well as by a method.

The fuel supply system for supplying an internal combustion engine with fuel according to the invention comprises an electric fuel pump allocated to a fuel tank, e.g., one half of a saddle tank, and particularly arranged within the fuel tank or the saddle tank half. A fuel line leading to the internal combustion engine is connected with the fuel pump. A return line for returning fuel toward the fuel pump is connected with the fuel line. The fuel returned through the return line is returned, for example, to the tank half of a saddle tank to which the fuel pump is allocated and/or to a surge pot to which the fuel pump is allocated. A shunt is connected to the fuel line in order to operate one or more sucking jet pumps arranged in the fuel tank for supplying the fuel pump. According to the invention, the fuel supply system comprises a pressure control system which controls the connection of the shunt with the fuel line as well as the connection of the return line with the fuel line. The pressure control system opens or closes the connection of the shunt to the fuel line at a first pressure and opens or closes the connection of the return line with the fuel line at a second pressure, the pressure control system opening the shunt and the return line when the pressure increases and closing them when the pressure drops. This means that when the internal combustion engine is started, the shunt and the return line are closed and opened only after the electric fuel pump has built up a correspondingly high pressure in the fuel line by supplying fuel.

Due to the fact that, according to the invention, both the return line and the shunt are closed when the internal combustion engine is started, the entire pump capacity that is comparatively low if it exists at all when the internal combustion engine is started is at the sole disposal of the internal combustion engine for the supply thereof. Due to the fact that only the internal combustion engine is supplied during the start, the internal combustion engine reaches its operational state very fast so that a sufficient board voltage for the operation of the electric fuel pump is reached very fast as well whereby the pressure in the fuel line increases very fast and the return line as well as the shunt are opened correspondingly fast for the fuel supply of the fuel pump. Thus, an improved starting behavior of the internal combustion engine is achieved by the fuel supply system according to the invention, whereby the electric supply of various electric consumers, such as the electric fuel pump in particular, is simultaneously improved. Further, it is not required to use an over dimensioned electric fuel pump since only the fuel pump is supplied when the internal combustion engine is started and thus, a smaller flow rate suffices to guarantee a reliable fuel supply. Thus, the fuel supply system according to the invention can have a very compact configuration. The starting procedure of the internal combustion engine in particular can be effected so fast that the fuel in the surge pot in particular suffices to effect the starting procedure even without operating a sucking jet pump.

For operating the sucking jet pump, the shunt is preferably opened before the return line is opened. This means that the first pressure at which the connection of the shunt to the fuel line is opened is lower than the second pressure at which the connection of the return line with the fuel line is opened so that the pressure control system has different operating pressures to branch off fuel from the fuel line.

In a preferred embodiment, the pressure control system comprises a first pressure controller connected with the shunt and a second pressure controller connected with the return line. Particularly, the pressure controllers are mechanical pressure controllers such as, e.g., ball valves, which are actuated at a certain pressure, i.e., at the first pressure and the second pressure, respectively, and open and close the shunt and the return line, respectively, with a characteristic line proportional to the throughput in particular. By means of the two pressure controllers, a cost-effective pressure control system with a particularly simple structure is formed.

Alternatively, the pressure control system may comprise a 3/3-way valve connected with the fuel line at the input side and respectively connected with the return line and the shunt at the output side. In a first switching state of the 3/3-way valve, both the shunt and the return line are separated from the fuel line. In a second switching state into which the 3/3-way valve switches at the first pressure, the shunt is connected with the fuel line whereas the return line remains closed. At the second pressure, the 3/3-way valve switches into a third switching state in which both the shunt and the return line are connected with the fuel line. If the first pressure and the second pressure have the same value, a valve with only two switching states, i.e., a 3/2-way valve, may be used as well in which the shunt with the return line are separated in a first switching state and both the diversion and the return line are connected with the fuel line in the second switching state. By means of the 3/3-way valve and the 3/2-way valve, respectively, the pressure control system can be configured in a very compact and room-saving manner.

For detecting the first pressure and the second pressure, the pressure control system is preferably connected with a pressure measuring means by which the pressure control system is controlled. For controlling the pressure control system, the pressure of the fuel line is particularly measured so that the first pressure and the second pressure are pressures of the fuel line. Preferably, the pressure is measured hydraulically, e.g. via a pressure measuring system with a baffle plate or the like.

It is particularly preferred that the fuel line comprises a pressure keeping valve. Particularly, the pressure keeping valve is arranged as close to the fuel pump as possible. Preferably, the pressure keeping valve directly connects to the fuel pump so that the pressure keeping valve is arranged between the fuel pump and the fuel line. The pressure keeping valve achieves that a part of the fuel line that is as large as possible is filled with fuel with a pressure of more than 1 bar when the internal combustion engine is switched off. Thereby, the fuel line is not only used to feed but also to store fuel since the fuel in the fuel line has a pressure that is sufficient for the supply of the internal combustion engine without the fuel pump being required to feed. If necessary, a further pressure keeping valve, e.g., a retaining valve, can be provided to be able to precisely define the region of the fuel line which is under an increased pressure even after the internal combustion engine has been switched off.

Further, the invention relates to a method for controlling the fuel supply of an internal combustion engine by means of which an improved starting behavior of an internal combustion engine particularly arranged in a motor vehicle is achieved in a particularly simple manner. In the method according to the invention, the internal combustion engine is started first. Upon starting the internal combustion engine, it is supplied from a fuel line comprising fuel and being connected with a fuel pump. Thereafter, fuel is fed into the fuel line by means of the fuel pump. Because of the feeding of the fuel pump, the pressure in the fuel line increases. Subsequently, a previously closed shunt is opened, which is connected with the fuel line and at least one sucking jet pump. The shunt is opened at a first pressure that is selected such that the internal combustion engine reliably starts. When the amount of the branched-off fuel increases, the pressure in the shunt particularly increases because of the resistance of the sucking jet nozzle(s) until the shunt pressure is substantially equal to the second pressure. Then, a previously closed return line is opened which is connected with the fuel line and returns fuel toward the fuel pump. The return line is opened at a second pressure that is the layout pressure, i.e., the operating pressure, of the internal combustion engine. If the first pressure and the second pressure are identical, the shunt and the return line are opened simultaneously. For the function of the sucking jet pump(s), the first pressure is preferably lower than the second pressure so that the shunt is opened before the return line.

To improve the fuel supply of the internal combustion engine, the fuel line preferably has a pressure of more than 1 bar when the internal combustion engine is started. This means that a pressure of more than 1 bar is provided in the fuel line before the internal combustion engine is started.

To finish the operation of the internal combustion engine, the internal combustion engine is preferably switched off first. Since, for this reason, the electric fuel pump is no longer supplied with power, the pressure in the fuel line drops. Subsequently, the return line is closed at the second pressure. Thereafter, the shunt is closed at the first pressure. If the first pressure and the second pressure are identical, the return line and the shunt will be closed simultaneously. After the shunt has been closed, the method step of closing the fuel line by means of a pressure keeping valve is particularly effected. Thereby, the pressure in the fuel line which is slightly lower than the first pressure lasts. It is particularly preferred to use a fuel supply system as described above for the method according to the invention.

BRIEF DESCRIPTION OF THE DRAWINGS

Hereinafter, the invention is explained in detail with reference to the accompanying drawings with respect to preferred embodiments thereof.

DETAILED DESCRIPTION OF PREFERRED EMBODIMENTS OF THE INVENTION

Figure 1:
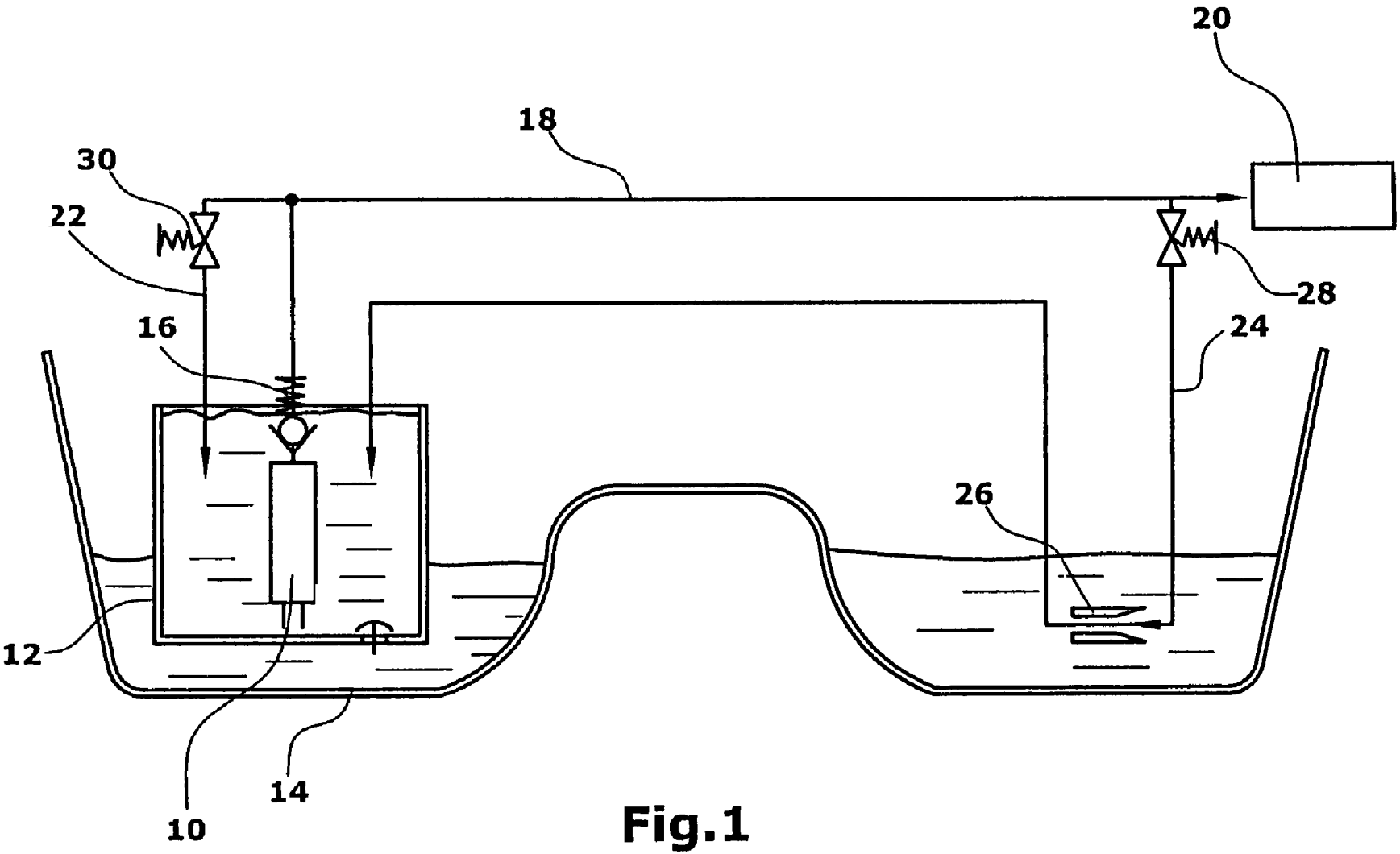
FIG. 1 shows a first embodiment of a fuel supply system according to the invention.

In a first embodiment of the fuel supply system according to the invention, an electric fuel pump 10 is arranged within a surge pot 12 in a tank 14, the tank 14 being a saddle tank in the illustrated embodiment. Via a pressure keeping valve 16, the fuel pump 10 is connected with a fuel line 18 leading to an internal combustion engine 20. A return line 22, which returns a part of the fuel fed by the fuel pump 10 into the surge pot 12, is connected with the fuel line 18. Due to the fact that a part of the fed fuel is circulated, the cooling of the fuel pump 10 is improved. Further, the fuel line 18 has a shunt 24 connected thereto via which a part of the fed fuel is fed to a sucking jet pump 26. With the sucking jet pump 26, fuel from the tank 14 is entrained by the fed fuel and fed into the surge pot 12. The sucking jet pump guarantees that there is enough fuel for the fuel pump 10 in the surge pot 12 so that the fuel pump does not feed air.

By means of a first pressure controller 28, the shunt 24 can be opened or closed. The first pressure controller 28 is actuated at a first pressure, the connection to the shunt 24 being opened when the pressure in the fuel line 10 increases and closed when the pressure in the fuel line 18 drops. Accordingly, the return line 22 comprises a second pressure controller 30 that opens or closes the connection between the return line 23 and the fuel line 18 at a second pressure. When the pressure in the fuel line 18 increases, the connection of the return line 22 with the fuel line 18 is opened and when the pressure in the fuel line 18 drops, it is closed.

By the pressure controllers 28,30, it is achieved that the fuel line 18 is only connected with the internal combustion engine 20 when the latter is started and the power supply of the electric fuel pump 10 is still insufficient. Thereby, the start of the internal combustion engine 20 as well as the start of the fuel pump 10 are accelerated in case of a compact structure of the fuel supply system according to the invention, whereby the fuel supply of the internal combustion engine 20 is improved.

In a second embodiment (FIG. 2), the shunt 24 and the return line 22 are connected with the fuel line 18 via a common intermediate line 32. The intermediate line 32 leads to a branch 34, in which the shunt 24 and the return line 22 of the intermediate line 32 are connected. In the illustrated embodiment, in contrast to FIG. 1, the first pressure controller 28 is formed by a first ball valve 36 and the second pressure controller 30 is formed by a second ball valve 38. The ball valves 36,38 are particularly formed such that the ball valve 36 opens at a lower pressure than the second ball valve 38.

Figure 2:
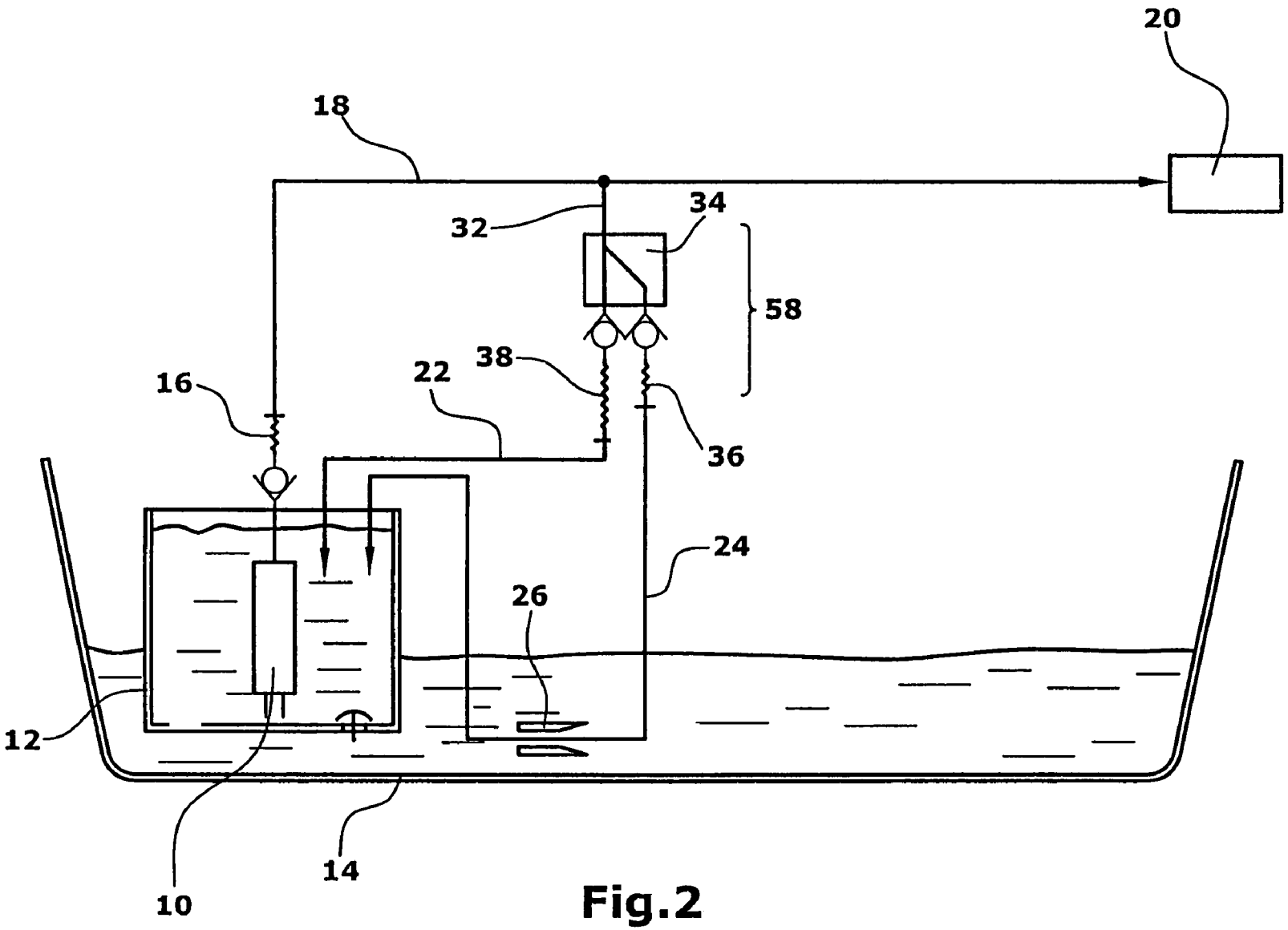
FIG. 2 shows a second embodiment of the fuel supply system.
Figure 3:
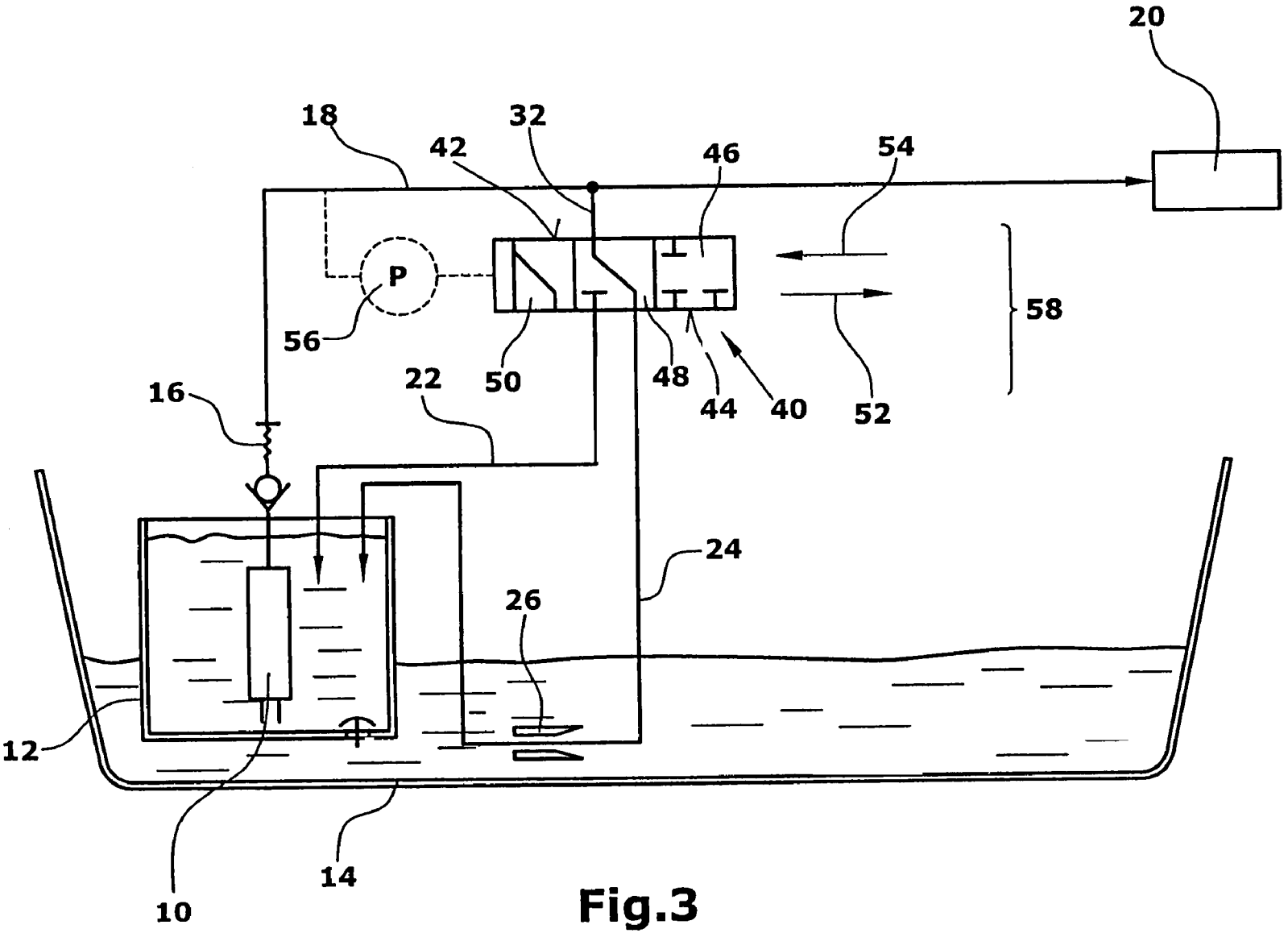
FIG. 3 shows a third embodiment of the fuel supply system.

In comparison with the fuel supply system illustrated in FIG. 2, the ball valves 36,38 as well as the branch 34 have been replaced by a 3/3-way valve 40 in a third embodiment of the fuel supply system (FIG. 3). The intermediate connection 32 is connected to an input side 42 of the 3/3-way valve 40 and the shunt 24 and the return line 24 are connected to an output side 44 of the 3/3-way system 40. In a first switching state 46, the shunt 24 and the return line 22 are closed. In a second switching state, the shunt 24 is opened, i.e., connected with the fuel line 18, whereas the return line 22 is closed. In a third switching state 50, both the shunt 24 and the return line 22 are opened and connected with the fuel line 18.

When the internal combustion engine 20 is started, the respective switching states 46,48,50 are run through, beginning with the first switching state 46, by displacing the 3/3-way valve 40 in the direction of the arrow 52 in the embodiment illustrated in FIG. 3. After the internal combustion engine 42 has been switched off, the respective switching states 46,48,50 are run through, beginning with the third switching state 50, by displacing the 3/3-way valve 40 in the direction of the arrow 54. For controlling the 3/3-way valve 40, a pressure measuring device 56 is provided which activates the respective switching states 46,48, 50 in dependence on the pressure measured in the fuel line 18.

This means that the fuel supply system according to the invention comprises a pressure control system 58 which is formed by the two pressure controllers 28,30 in the first embodiment (FIG. 1), by the branch 34 and the ball valves 36,38 in a second embodiment (FIG. 2), and by the 3/3-way valve 40 in the third embodiment (FIG. 3).

Although the invention has been described and illustrated with reference to specific illustrative embodiments thereof, it is not intended that the invention be limited to those illustrative embodiments. Those skilled in the art will recognize that variations and modifications can be made without departing from the true scope of the invention as defined by the claims that follow. It is therefore intended to include within the invention all such variations and modifications as fall within the scope of the appended claims and equivalents thereof.

What is claimed is:

1. A fuel supply system for supplying an internal combustion engine with fuel, comprising:

an electric fuel pump allocated to a fuel tank, a fuel line leading to the internal combustion engine and connected with the fuel pump, a return line connected with the fuel line, for returning fuel toward the fuel pump, a shunt connected with the fuel line, for operating a sucking jet pump arranged in the fuel tank, and a pressure control system opening or closing the connection of the shunt to the fuel line at a first pressure and opening or closing the connection of the return line with the fuel line at a second pressure, the pressure control system opening the shunt and the return line when the pressure increases and closing them when the pressure drops, wherein said pressure control system comprises a 3/3-way valve that is connected with the fuel line at the input side and respectively connected with the return line and with the shunt at the output side.

2. The fuel supply system according to claim 1, wherein said pressure control system comprises a first mechanical pressure controller connected with the shunt and a second mechanical pressure controller connected with the return line.

3. The fuel supply system according to claim 1, wherein said first pressure is lower than said second pressure.

4. The fuel supply system according to claim 1, wherein said pressure control system is connected with a pressure measuring device that measures the pressure of the fuel line for controlling the pressure control system.

5. The fuel supply system according to claim 1, wherein said fuel line has a pressure keeping valve which is as close to the fuel pump as possible.

6. The fuel supply system according to claim 1, wherein said fuel pump is arranged in a surge pot into which the shunt and the return line feed.

7. The fuel supply system according to claim 1, wherein the second pressure is the operating pressure of the internal combustion engine.

* * * * *